US011965526B2

(12) United States Patent
Lavagna et al.

(10) Patent No.: US 11,965,526 B2
(45) Date of Patent: Apr. 23, 2024

(54) INLET COMPONENT FOR A SLURRY PUMP

(71) Applicant: Weir Minerals Australia Ltd., Artarmon (AU)

(72) Inventors: Luis Moscoso Lavagna, North Ryde (AU); Nestor Cinotti, Elanora Heights (AU); David Alan Hamilton, Forestville (AU)

(73) Assignee: Weir Minerals Australia Ltd. (AU)

( * ) Notice: Subject to any disclaimer, the term of this patent is extended or adjusted under 35 U.S.C. 154(b) by 130 days.

(21) Appl. No.: 17/284,603

(22) PCT Filed: Oct. 12, 2018

(86) PCT No.: PCT/AU2018/051107
§ 371 (c)(1),
(2) Date: Apr. 12, 2021

(87) PCT Pub. No.: WO2019/071318
PCT Pub. Date: Apr. 18, 2019

(65) Prior Publication Data

US 2021/0254630 A1 Aug. 19, 2021

(30) Foreign Application Priority Data

Oct. 12, 2017 (AU) ..... 2017904120

(51) Int. Cl.
*F04D 29/42* (2006.01)
*F04D 7/04* (2006.01)
*F04D 29/24* (2006.01)

(52) U.S. Cl.
CPC ..... *F04D 29/4293* (2013.01); *F04D 7/04* (2013.01); *F04D 29/24* (2013.01)

(58) Field of Classification Search
CPC ..... F04D 7/04; F04D 29/026; F04D 29/167; F04D 29/22; F04D 29/2255;
(Continued)

(56) References Cited

U.S. PATENT DOCUMENTS 3,447,475 A * 6/1969 Blum ..... F04D 29/167 416/185
3,907,456 A 9/1975 Krienke
(Continued)

FOREIGN PATENT DOCUMENTS

| | | |
|---|---|---|
| EP | 3171029 A1 | 5/2017 |
| JP | H094585 A | 1/1997 |
| WO | 2012012622 A2 | 1/2012 |

OTHER PUBLICATIONS

Japan Search Report for JP Application 2021-519611 (counterpart application), dated Aug. 31, 2022 (in Japanese with English translation).

*Primary Examiner* — Brian O Peters
(74) *Attorney, Agent, or Firm* — Morriss O'Bryant; Compagni Cannon, PLLC.

(57) ABSTRACT

A pump side part for use with a centrifugal slurry pump for pumping a fluid mixture containing particulate matter, the pump side part comprising a main body having a main axis, the main body including a side wall section which extends laterally with respect to the main axis and has opposite facing first and second sides, a plurality of formations on a surface of the second side including an inner formation and an outer formation in spaced relation to the inner formation, the formations being configured so that in use the formations generate a flow of the fluid mixture across the surface which detaches from the surface the particulate matter adjacent thereto.

13 Claims, 7 Drawing Sheets

(58) Field of Classification Search
CPC ..... F04D 29/2266; F04D 29/2288; F04D 29/2294; F04D 29/426; F04D 29/4273; F04D 29/4293; F01D 5/143; F05D 2260/607
See application file for complete search history.

(56) References Cited

U.S. PATENT DOCUMENTS

| | | | | |
|---|---|---|---|---|
| 4,143,993 | A | 3/1979 | Blum | |
| 5,516,261 | A | 5/1996 | Zelder | |
| 7,766,605 | B2 * | 8/2010 | Lindskog ..... | F04D 29/167 415/168.3 |
| 8,608,445 | B2 | 12/2013 | Burgess et al. | |
| 2004/0136825 | A1 * | 7/2004 | Addie ..... | F04D 29/4273 415/121.2 |
| 2006/0127211 | A1 | 6/2006 | Walker et al. | |
| 2007/0274820 | A1 | 11/2007 | Lindskog | |
| 2013/0243634 | A1 | 9/2013 | Ciro et al. | |
| 2014/0030086 | A1 | 1/2014 | Staley et al. | |
| 2014/0241888 | A1 | 8/2014 | Lavagna et al. | |

* cited by examiner

INLET COMPONENT FOR A SLURRY PUMP

TECHNICAL FIELD

This disclosure relates generally to centrifugal pumps and more particularly to slurry pumps. Slurries are usually a mixture of liquid and particulate solids, and are commonly found in minerals processing, sand and gravel and/or dredging industry. The disclosure is particularly concerned with an improved pump side component which may form part of a pump liner. The pump side component may in some applications form part of an unlined pump; that is a pump having a pump casing with no separate liners.

BACKGROUND ART

One form of centrifugal slurry pumps generally comprises an outer pump casing which encases a liner. The liner has a pumping chamber therein which may be of a volute, semi volute or concentric configuration, and is arranged to receive an impeller which is mounted for rotation within the pumping chamber. A drive shaft is operatively connected to the pump impeller for causing rotation thereof, the drive shaft entering the pump casing from one side. The pump further includes a pump inlet which is typically coaxial with respect to the drive shaft and located on the opposite side of the pump casing to the drive shaft. There is also a discharge outlet typically located at a periphery of the pump casing. The liner includes a main liner (sometimes referred to as the volute) and front and back side liners which are encased within the outer pump casing. The front side liner is often referred to as the front liner suction plate or throatbush. The back side liner is often referred to as the frame plate liner insert.

The impeller typically includes a hub to which the drive shaft is operatively connected, and at least one shroud. Pumping vanes are provided on one side of the shroud with discharge passageways between adjacent pumping vanes. The impeller may be of the closed type where two shrouds are provided with the pumping vanes being disposed therebetween. The shrouds are often referred to as the front shroud adjacent the pump inlet and the back shroud. This may also be of the open face type which comprises one shroud only.

One of the major wear areas in the slurry pump is the front and back side-liners. Slurry enters the impeller in the centre or eye, and is then flung out to the periphery of the impeller and into the pump casing. Because there is a pressure difference between the casing and the eye, there is a tendency for the slurry to try and migrate into a gap which is between the side-liners and the impeller, resulting in high wear on the side-liners.

In order to try and reduce wear in the region of the gap, it has been the practice for slurry pumps to have auxiliary or expelling vanes on the front shroud of the impeller. Auxiliary or expelling vanes may also be provided on the back shroud. The expelling vanes rotate the slurry in the gap creating a centrifugal field and thus reducing the driving pressure for the returning flow, reducing the flow velocity and thus the wear on the side-liner. The purpose of these auxiliary vanes is to reduce flow re-circulation through the gap. These auxiliary vanes also reduce the influx of relatively large solid particles in this gap. While the auxiliary vanes are effective particularly in handling the larger solid particulates in the slurry mixture in the gap they can be less effective in handling the smaller particulates in the slurry mixture which is immediately adjacent the surface of the side part.

SUMMARY OF THE DISCLOSURE

In a first aspect, embodiments are disclosed of a pump side part for use with a centrifugal slurry pump for pumping a fluid mixture contain particulate matter, the pump side part comprising a main body having a main axis, the main body including a side wall section which extends laterally with respect to the main axis and has opposite facing first and second sides, a plurality of formations on a surface of the second side including an inner formation and an outer formation in spaced relation to the inner formation, the formations being configured so that in use the formations generate a flow of the fluid mixture across the surface which detaches from the surface the particulate matter adjacent thereto.

In certain embodiments the main body includes an outer peripheral side wall or rim extending between the first and second sides, the second side having an outer edge adjacent the peripheral side wall or rim and an inner edge, the formations being generally circular or ring like in configuration when viewed in the direction of the main axis and arranged generally concentrically with the main axis.

In a second aspect, embodiments are disclosed of a pump side part comprising a main body having a main axis the main body including a side wall section which extends laterally with respect to the main axis and has opposite facing first and second sides, an outer peripheral side wall or rim extending between the first and second sides, the second side having an outer edge adjacent the peripheral side wall or rim and an inner edge; a plurality of formations on a surface of the second side including an inner formation and an outer formation in spaced relation to the inner formation, the formations being generally circular or ring like in configuration when viewed in the direction of the main axis and arranged generally concentrically with the main axis.

In certain embodiments, the inner formation is adjacent to the inner edge and the outer formation is adjacent to the outer edge.

In certain embodiments, the side part further includes one or more intermediate formations, the intermediate formations being generally circular ring like in configuration and arranged concentrically with the main axis and in spaced relation to one another and the inner and outer formations.

In certain embodiments, the formations are in the form of channels or recesses in the surface of the second side.

In certain embodiments, the channels are generally continuous and arcuate in cross-sectional profile.

In certain embodiments, the surface of the second side is generally wave like in cross-sectional profile.

In certain embodiments, the adjacent formations are spaced apart by a distance approximately the width of the channel or recess.

In certain embodiments, the formations have generally smooth sides and include a smooth transition between formations along the surface of the second side.

In certain embodiments the formations include formation curves that are inclined from a plane in line with the general direction of the surface 37,16 at less than 45°.

In certain embodiments, the second side includes a section which is generally at right angles to the main axis.

In certain embodiments, wherein the main body further includes an inlet section which extends from the first side in the directions of the main axis and generally co-axial therewith.

In certain embodiments, the second side includes a section which is inclined towards the inlet section.

In certain embodiments, the pump side part is a back side part.

In certain embodiments, the pump side part is a front side part.

In a third aspect, embodiments are disclosed of the combination of a slurry pump side part as described above and a slurry pump impeller, the impeller comprising one or more shrouds and a plurality of pumping vanes the or each shroud having an outer face and an impeller inlet, the impeller inlet being coaxial with an impeller rotation axis; wherein the outer face of the impeller shroud and the surface of the second side of the pump side part are arranged in used to be facing one another with a gap therebetween the gap having an outer gap having an outer opening and an inner opening.

In certain embodiments, the front shroud outer face of the impeller includes an outer region, an inner region and an intermediate region therebetween, the intermediate region being in a plane generally at right angles to the impeller rotation axis and the inner region being inclined towards the pumping vanes; and wherein the surface of the second side of the pump part includes an outer region with an inner regions and an intermediate region between the outer and inner regions which is inclined from the said plane in a direction towards the inlet section, the inner region extending in a direction away from the intermediate region and in a direction away from the front side of the side wall section and generally following the inner region of the outer face of the impeller front shroud, and wherein the outer face of the impeller front shroud and the surface of the second side of the pump side part are arranged in use to be facing one another with a gap therebetween the gap having an outer opening and an inner opening, the surface of the second side of the side wall section being configured so that the cross-sectional dimension of the gap increases in a direction toward the impeller rotation axis in the intermediate region, and the inner region terminating at the inner opening.

Other aspects, features, and advantages will become apparent from the following detailed description when taken in conjunction with the accompanying drawings, which are a part of this disclosure and which illustrate by way of example, principles of inventions disclosed.

BRIEF DESCRIPTION OF THE DRAWINGS

Notwithstanding any other forms which may fall within the scope of the method and apparatus as set forth in the Summary, specific embodiments of the method and apparatus will now be described, by way of example, and with reference to the accompanying drawings in which.

DETAILED DESCRIPTION OF SPECIFIC EMBODIMENTS

Figure 1:
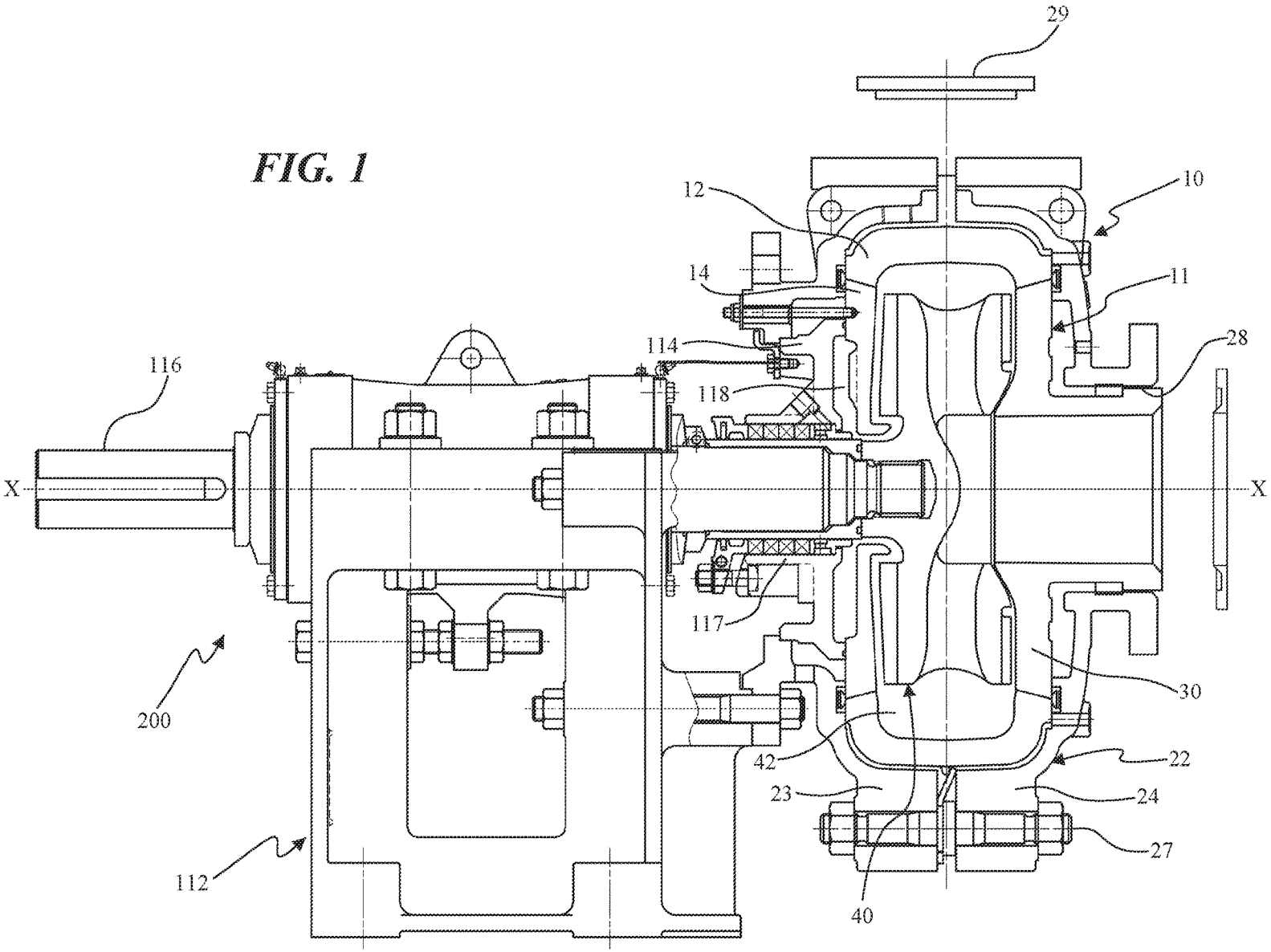
FIG. 1 is a schematic partial cross-sectional side elevation of one form of a pump apparatus.

Referring in particular to FIG. 1 of the drawings, there is generally illustrated pump apparatus 200 comprising a pump 10 and pump housing support in the form of a pedestal or base 112 to which the pump 10 is mounted. Pedestals are also referred to in the pump industry as frames. The pump 10 generally comprises an outer casing 22 that is formed from two side casing parts or sections 23, 24 (sometimes also known as the frame plate and the cover plate) which are joined together about the periphery of the two side casing sections 23, 24. The pump 10 is formed with side openings one of which is an inlet hole 28 there further being a discharge outlet hole 29 and, when in use in a process plant, the pump is connected by piping to the inlet hole 28 and to the outlet hole 29, for example to facilitate pumping of a mineral slurry.

Figure 2:
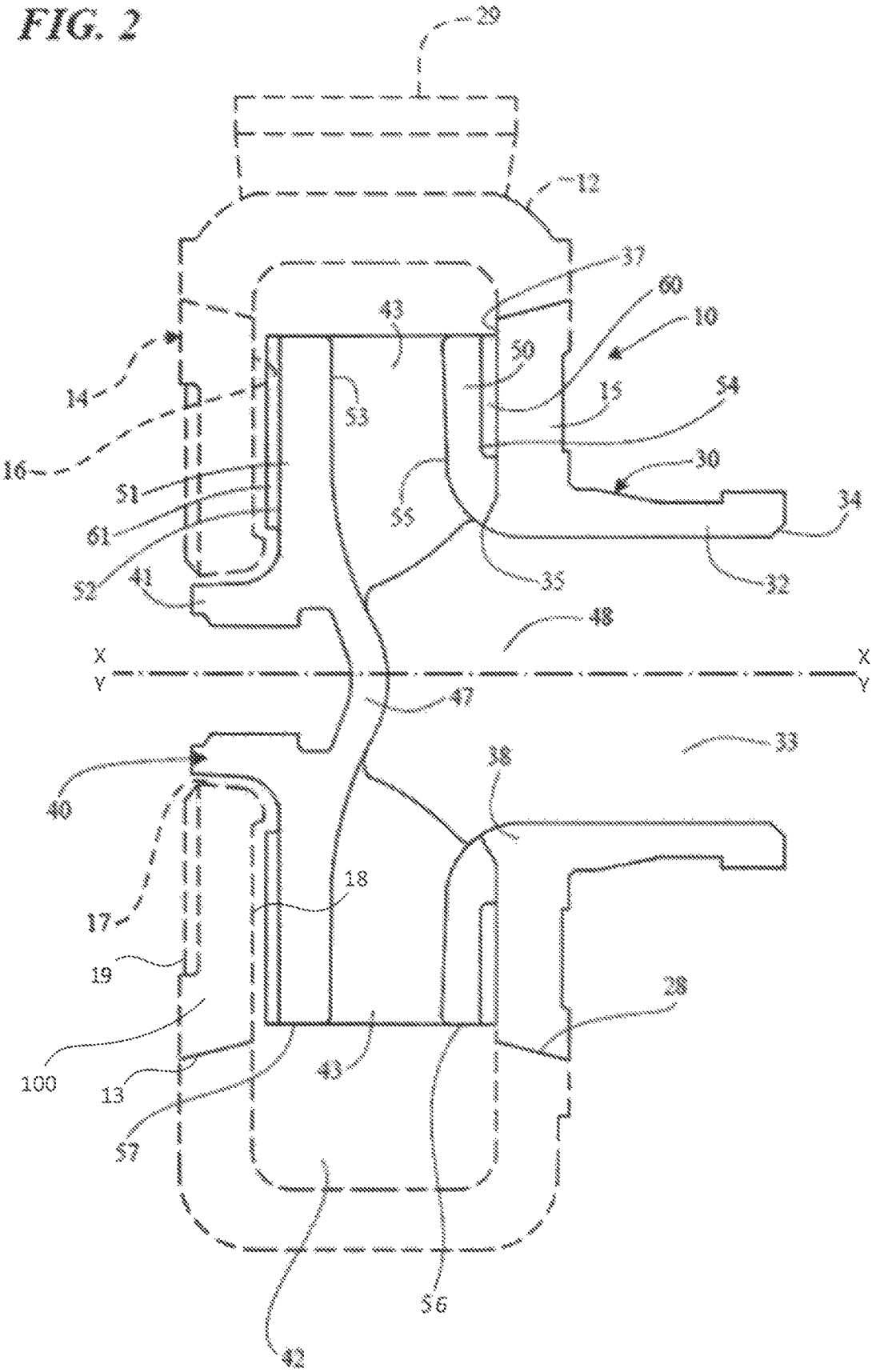
FIG. 2 is a more detailed schematic partial cross-sectional side elevation of part of a pump apparatus.

The pump 10 further comprises a pump inner liner 11 arranged within the outer casing 22 and which includes a main liner 12 and two side liners 14, 30. The side liner 14 is located nearer the rear end of the pump 10 (that is, nearest to the pedestal or base 112), and the other side liner (or front liner) 30 is located nearer the front end of the pump and inlet hole 28. The side liner 14 is also referred to as the back side part or frame plate inner insert and the side liner 30 is also referred to as the front side part or throatbrush. The main liner comprises two side openings therein. As shown in FIG. 2 the back side liner 14 comprises a disc like main body 100 having an inner edge 17 and an outer edge 13. The main body 100 has a first side 19 and a second side 18 with a side surface 16.

As shown in FIG. 1 the two side casing parts 23, 24 of the outer casing 22 are joined together by bolts 27 located about the periphery of the casing parts 23, 24 when the pump is assembled for use. In some embodiments the main liner 12 can also be comprised of two separate parts which are assembled within each of the side casing parts 23, 24 and brought together to form a single main liner, although in the example shown in FIG. 1 the main liner 12 is made in one-piece, shaped similar to a car tyre. The liner 11 may be made of materials such as rubber, elastomer or of metal.

When the pump is assembled, the side openings in the main liner 12 are filled by or receive the two side liners 14, 30 to form a continuously-lined pumping chamber 42 disposed within the pump outer casing 22. A seal chamber housing 114 encloses the side liner (or back side part) 14 and is arranged to seal the space or chamber 118 between drive shaft 116 and the pedestal or base 112 to prevent leakage from the back area of the outer casing 22. The seal chamber housing takes the form of a circular disc section and an annular section with a central bore, and is known in one arrangement as a stuffing box 117. The stuffing box 117 is arranged adjacent to the back side liner 14 and extends between the pedestal 112 and a shaft sleeve and packing that surrounds drive shaft 116.

As shown in FIGS. 1 and 2 an impeller 40 is positioned within the main liner 12 and is mounted or operatively connected to the drive shaft 116 which is adapted to rotate about a rotation axis X-X. A motor drive (not shown) is normally attached by pulleys to an exposed end of the shaft 116, in the region behind the pedestal or base 112. The rotation of the impeller 40 causes the fluid (or solid-liquid mixture) being pumped to pass from a pipe which is connected to the inlet hole 28 through the pumping chamber 42 which is within the main liner 12 and the side liners 14, 30 and then out of the pump via the discharge outlet hole 29.

The impeller 40 includes a hub 41 from which a plurality of circumferentially spaced pumping vanes 43 extend. An eye portion 47 extends forwardly from the hub 41 towards the passage 33 in the front liner 30. The impeller 40 further includes a front shroud 50 and a back shroud 51, the vanes 43 being disposed and extending therebetween and an impeller inlet 48. The hub 41 extends through a hole 17 in back liner 14.

The impeller front shroud 50 includes an inner face 55, an outer face 54 and a peripheral edge portion 56. The back shroud 51 includes an inner face 53, an outer face 52 and a peripheral edge portion 57. The front shroud 50 includes an inlet 48, being the impeller inlet and the vanes 43 extend between the inner faces of the shrouds 50, 51. The shrouds are generally circular or disc-shaped when viewed in elevation; that is in the direction of rotation axis X-X.

As illustrated in FIG. 2, each impeller shroud has a plurality of auxiliary or expelling vanes on the outer faces 52, 54 thereof, there being a first group of auxiliary vanes 60 on the outer face 54 of the front shroud 50 and a second group of auxiliary vanes 61 on the outer face 52 of the back shroud 51.

Figure 3:
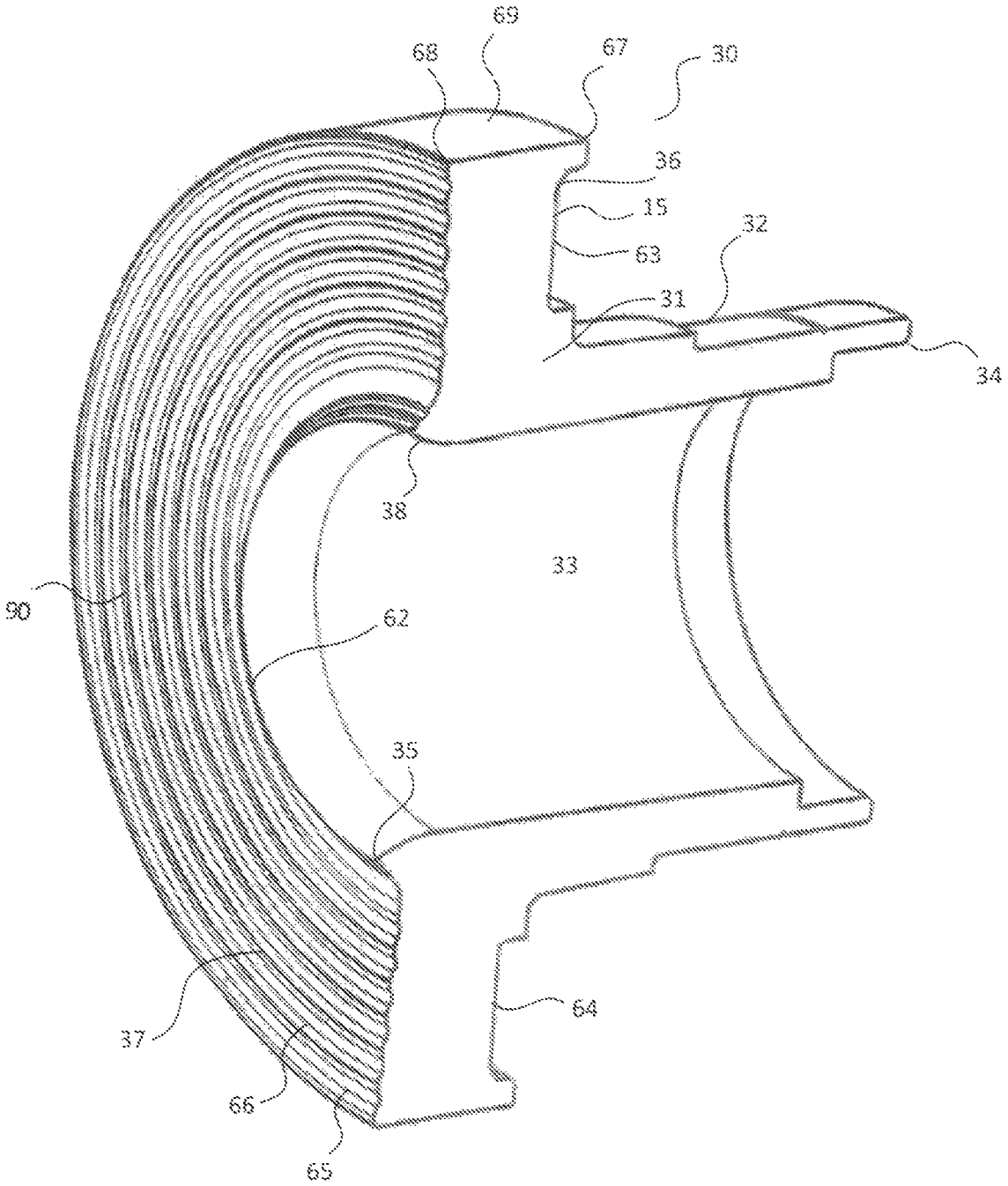
FIG. 3 is a partially cut away isometric view of a pump side part according to one embodiment.
Figure 6:
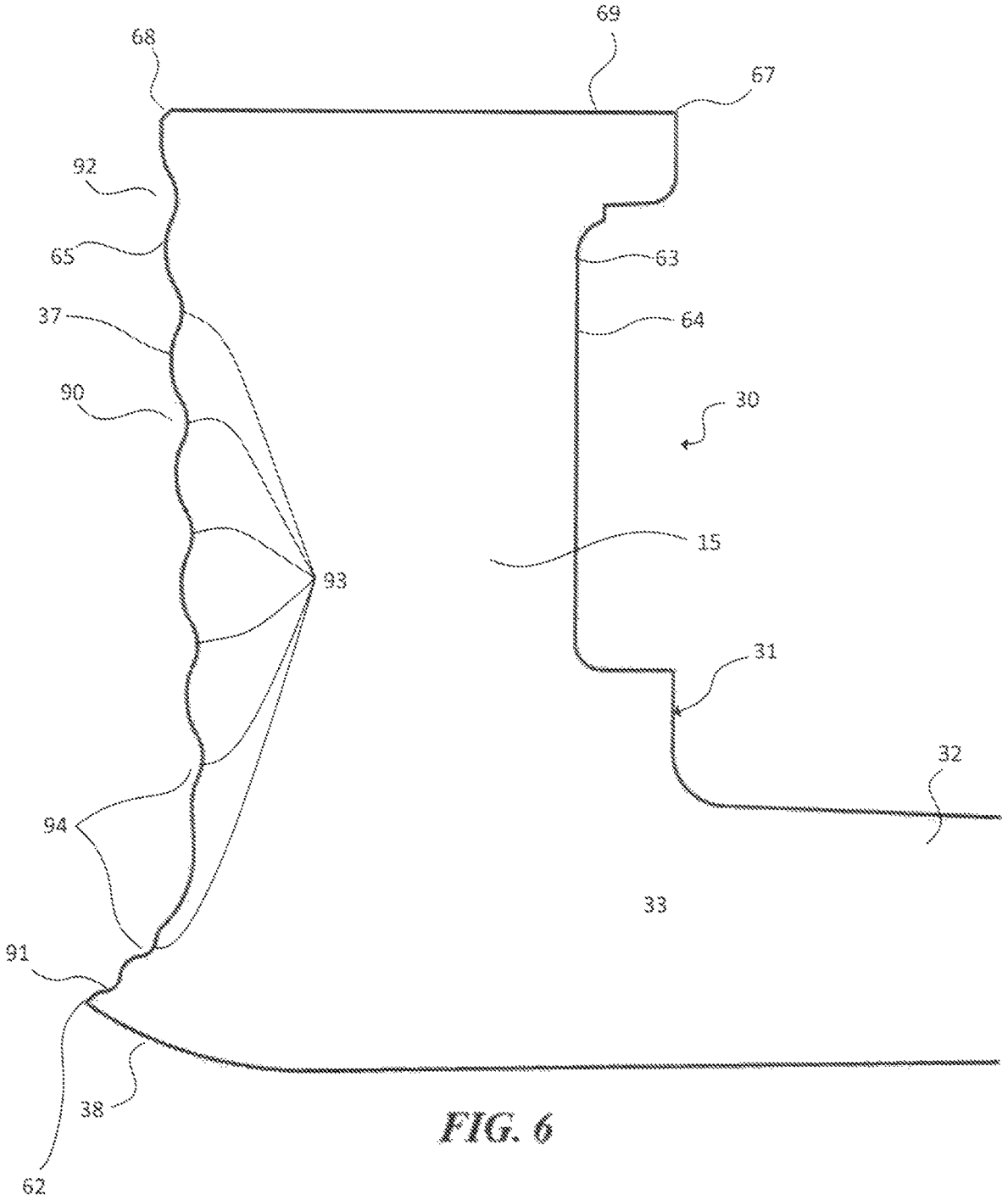
FIG. 6 is a more detailed view of part of a pump side part according to another embodiment.

As shown in particular in FIGS. 3 and 6, the side part which in the illustrated form comprises a front side part 30 (also referred to as a front liner or throatbrush) comprises a main body 31 which includes a cylindrically-shaped delivery or inlet section 32 through which slurry enters the pumping chamber 42 when the pump is in use. The delivery section 32 has a passage 33 therein with a first, outermost end 34 operatively connectable to a feed pipe (not shown) and a second, innermost end 35 adjacent the chamber 42 (FIG. 2). The front liner 30 further includes a side wall section which mates in use with main liner 12 to form and enclose the pumping chamber 42 at the front end. The second end 35 of the front liner 30 has a raised lip 38 thereat, which is arranged in a close facing relationship with the impeller 40 when in an assembled position.

The front side part 30 has a main or central axis Y-Y (FIGS. 4 and 5) which in an assembled position is co-axial with impeller rotation axis X-X. The side wall section 15 comprises first and second oppositely facing sides 63 and 65, the first side 63 facing outwardly away from the impeller 40 when in an assembled position. The delivery or inlet section 32 extends through the sidewall section 15 and outwardly away from the impeller 40. The first and second sides 63 and 65 have oppositely facing surfaces 36 and 37. The sides have outer edges 67 and 68 with a rim or peripheral side wall 69 extending from one edge 67 to the other 68. The second side 65 also has an inner edge 62 adjacent to the passage 33.

Figure 4:
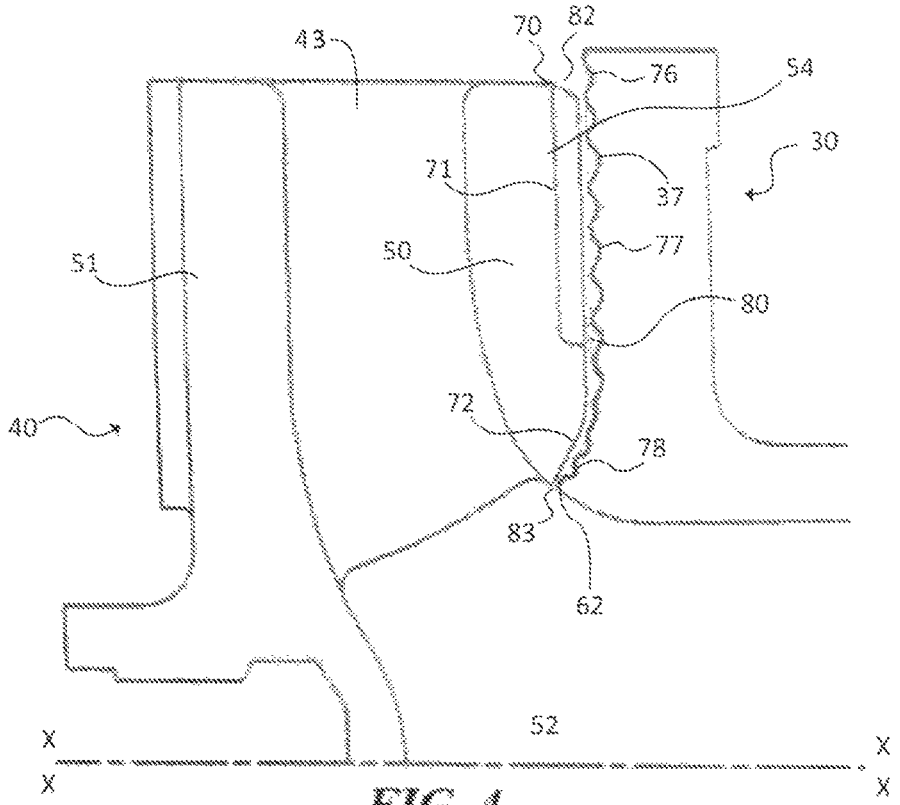
FIG. 4 is a sectional view of a pump side part according to another embodiments.
Figure 5:
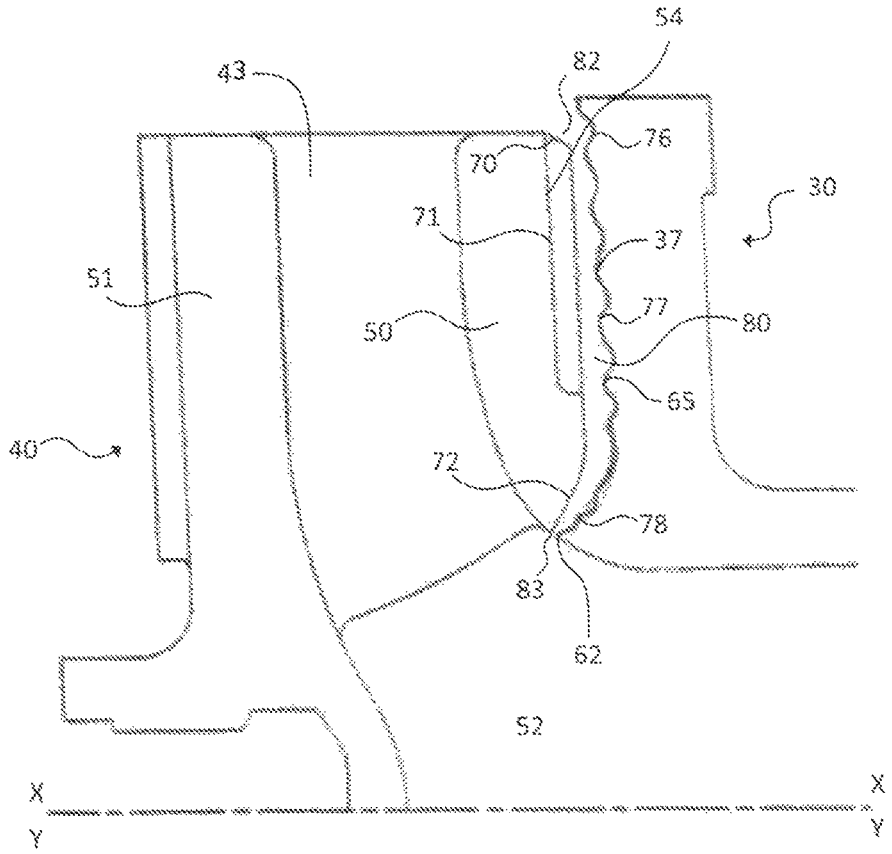
FIG. 5 is a sectional view of a pump side part according to another embodiment.

As shown in FIGS. 4 and 5 the impeller 40 comprises a front shroud 50, a back shroud 51 and a plurality of pumping vanes 43 therebetween, the front shroud 50 having an outer face 54 and an impeller inlet 52 extending through the front shroud 50, the impeller inlet 52 being coaxial with an impeller rotation axis X-X the front shroud outer face 54 including an outer region 70, an intermediate region 71 being in a plane generally at right angles to the impeller rotation axis X-X and an inner region 72 which is inclined towards the pumping vanes 42.

FIGS. 4 and 5 illustrate two different embodiments. In FIGS. 4 and 5 the surface 37 of the second side 65 comprises an outer region 76, an intermediate region 77 and an inner region 78. In the embodiment of FIG. 4 the outer and intermediate regions 76 and 77 are generally at right angles to the main axis Y-Y. The inner region 78 is inclined inwardly towards the impeller and generally follows the inner region 72 of the outer face 54 of the impeller front shroud 50.

In the embodiment of FIG. 5 the intermediate region 77 is inclined from a plane containing the outer region 76 in a direction towards the inlet section 32. The inner region 78 is of similar configuration to that of FIG. 4.

The outer face 54 of the impeller front shroud 50 and surface 37 of the second side 65 of the pump side part 30 are arranged in use to be facing one another with a gap 80 therebetween the gap 80 having an outer opening 82 and an inner opening 83, the second side of the side wall section 15 being configured so that in the case of FIG. 5 the cross-sectional dimension of the gap 80 increases in a direction toward the impeller rotation axis X-X in the intermediate region 71, the inner region 78 terminating at the inner opening 83.

The dimension of the gap 80 between the inner region 72 of the outer face 54 of the impeller front shroud 50 and the inner region 78 of the surface 37 of the pump side part 30 decreases in the direction from the intermediate region 77 towards the inner edge 62.

As shown in detail in FIG. 6 the surface 37 of the second side 65 has a series of spaced apart formations 90 thereon and includes an innermost formation 91 and an outermost formation 92 with one or more intermediate formations 93 therebetween. As shown in FIG. 3, the formations are generally circular or ring like and are concentrically arranged with respect to the main axis Y-Y. The outermost formation 92 is adjacent to (that is at or in the region of) the outer edge 68 of the second side 65 and the innermost formation 91 is adjacent to (that is at or in the region of) the inner edge 62. As best seen in FIG. 3 the formations are distributed substantially over the entire surface of the second side. As best illustrated in FIG. 6 the inner region 78 of the surface 37 of the second side 65 has two formations 91 thereon; the other part of the surface 37 has six formations 90 thereon.

In the embodiment shown in FIG. 6, the inner region 78 includes formations 91 of a smaller size than the formations of the other part of the surface 37. Due to the size of the length of the inner region 78 shown in the embodiment of FIG. 6, it is preferred that the inner region 78 contain a maximum of two formations 91.

Figure 7:
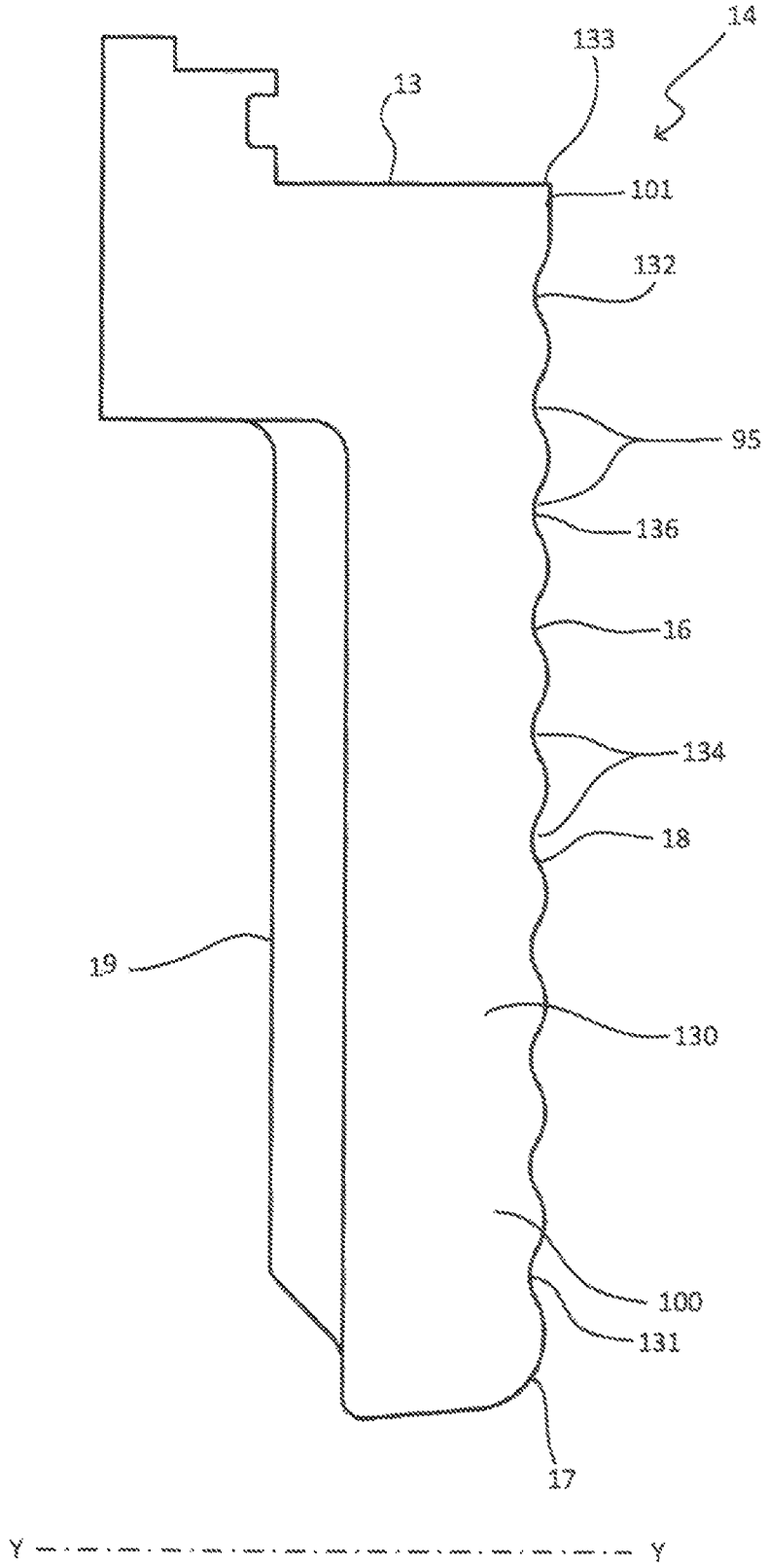
FIG. 7 is a more detailed sectional view of a portion of a pump side part according to another embodiment; and, FIG. 8 is a further image of the side part of FIG. 7 depicting a relationship with respect to formations appearing thereon.
Figure 8:
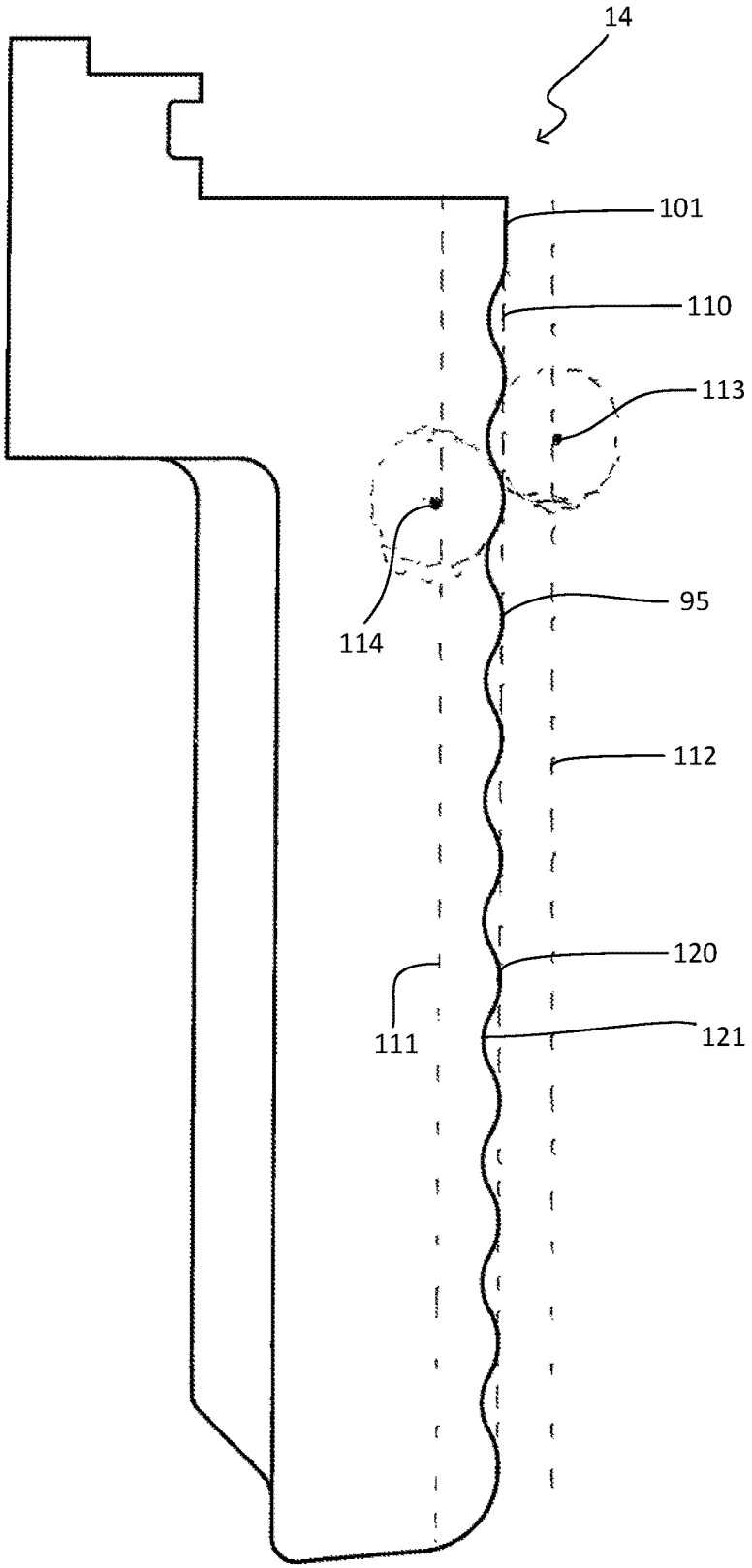

FIGS. 7 and 8 illustrate a further embodiment of a pump side part in the form of a back side part or frame plate liner 14. The back side part 14 comprises a disc like main body 100 having an inner edge 17 and an outer edge 13. The main body 100 has a first side 19 and a second side 18 with a side surface 16. The main body 100 of the back side part 14 includes a main axis Y-Y and a side wall section 130 which extends laterally with respect to the main axis Y-Y with opposing facing first side 19 and second side 18. The back side part 14 also includes an outer peripheral side wall or rim 13 extending between the first side 19 and second side 18. The second side 18 has an outer edge 133 adjacent the peripheral side wall or rim 13 and an inner edge 17. A plurality of formations 95 are located on the surface 16 of the second side 18 which include an inner formation 131 and an outer formation 132 in spaced relation to the inner formation 131, the formations 95 being generally circular or ring like in configuration when viewed in the direction of the main axis (Y-Y) and arranged generally concentrically with the main axis (Y-Y). The inner formation 131 is adjacent to the inner edge 17 and the outer formation 132 is adjacent to the outer edge 133. The back side part 14 further includes intermediate formations 134 being generally circular ring like in configuration and arranged concentrically with the main axis (Y-Y) and in spaced relation to one another and the inner and outer formations 131,132.

The formations may be in the forms of channels or recesses 94,136 in the surface 37, 16 although in an alternative embodiment they may be in the form of raised projections extending from the surface 37, 16. As best seen in FIGS. 6, 7 and 8 the formations 90,95 have a curved profile and thereby provide for a generally wave like surface which may be generally sinusoidal like in shape. The formations 90,95 as shown are in the form of continuous or uninterrupted concentric ring like channels 94,136 or recesses.

The formations 90,95 may have generally smooth sides and smooth transition between formations along the surface 37,16 wherein the formations include formation curves that are inclined from a plane 140,142,143 in line with the general direction of the surface 37,16 at less than 45°. Otherwise stated the transition between the formations 90,95 along the surface of the second side 37,16 is free from any portions or intermediate surfaces that are inclined at greater than 45° from a plane in line with the general direction of the surface 37,16.

In another embodiment and with reference to FIG. 8, the formations are in the form of a channels 94,136 into the surface 37,16 where the depth of the channel is depicted relative to a plane 110 that is in line with the general direction of the surface 37,16. As is depicted the curved shape of the channels 94,136 form a segment with the plane 110 wherein a circle sized to include the arc of the segment has a centre 113. The sagitta of the segment (also known as the height of the arc of the segment) is less than the radius of the circle with centre 113. In preferred forms, the sagitta is less than 70% of the length of the radius of the circle sized to include the arc of the segment. In preferred forms, the sagitta is less than 50% of the length of the radius of the circle sized to include the arc of the segment. The same relationship with the structure of the formations may be applied to the front side part 37 depicted in FIG. 6. Although when considering the embodiment of the front side part as shown in FIGS. 4, 5 and 6 the plane in the general direction of the surface follows the general direction of the surfaces of the inner region 78, intermediate region 77 and outer region 76 when related to the formations appearing on these respective regions.

In another embodiment, the formations are in the form of channels 94,136 where the cross sectional shape is such that the arcs (of circle) composing the formations connect with one another other in a tangential manner.

The formations 90,95 act on the slurry mixture adjacent the surface 37,16 of the second side 65,18 of the pump side part causing the flow to develop an undulating motion whereby the particles adjacent to the surface tend to become detached or more separated from the inner surface. Otherwise stated, the distribution of the formations 90,95 across a surface 37,16 of a pump side part effects the turbulence of the particles and reduces settlement at particular localised locations thereby decreasing localised wear when the centrifugal slurry pump is in use.

In certain embodiments, the pump side parts 14,30 as herein described are used with centrifugal slurry pumps where transport of solids in the form of slurries is involved. Applications for the centrifugal slurry pumps are often found in the mining industry where slurries are transported. The pump side parts are located in regions of the centrifugal slurry pump where slurry must pass through sealing gaps in the centrifugal pump assembly. As a result, the slurry material that is in contact with the pump side parts 14,30 may typically have a particle size with an average diameter of 300 microns. The slurry material that is in contact with the pump side parts may also have a particle size diameter in the range of 100 micron to 1000 micron. The slurry material that is in contact with the pump side parts may also have a specific gravity of between 1.5 to 3.8.

Experimental Simulation

Computational experiments were carried out to simulate flow patterns in various designs of side part, using commercial software ANSYS CFX to compare currently known side parts with a side part having formations in the form disclosed. This software applies Computational Fluid Dynamics (CFD) methods to solve the velocity field for the fluid being pumping. The software is capable of solving many other variables of interest however velocity and vorticity are the variables which have been considered.

The simulations showed that the side part having formations as described caused a reduction in the velocity of the slurry in the region of the gap between the side part and the impeller for the different BEP flow rates compared with conventional side parts. This led to a reduction of wear of the component.

As is known the front side part or liner provides for a sealing function, inhibiting the fluid energised by the impeller from returning to the suction main stream. In general, the gap between the impeller and this side liner is very small (for example 0.5 to 5 mm). this proximity, in the case of centrifugal slurry pumps, is responsible for the high erosion rates the part endures, becoming eventually the component with the shortest life cycle. This tight proximity reduces the options for geometry changes intended to improve wear life without effecting over overall performance.

The liquid-solids mixture entering the gap between the rotating impeller and static side part or liner has a very erosive action on the surface thereof, that being an inner surface adjacent to and facing the impeller. The severity of this erosion depends on the pump parameters and mixture characteristics, but the principle is basically the fluid flow upon the component, but at the same time seeking to maintain the pump performance.

The formations act on the slurry mixture adjacent the surface of the second side of the pump side part causing the flow to develop an undulating motion whereby the particles adjacent to the surface tend to become detached or more separated from the inner surface. By causing the detachment the erosive action and the wear caused by the particulates in the flow stream adjacent the surface is reduced. In certain embodiments the gap width can vary starting from a minimum width at the periphery of the surface to a maximum distance closer to impeller/liner eye region, and then approaching minimum distance at the inner edge.

The progressive wide impeller side liner gap reduces the velocity and erosive action of mixture flow layer close to the liner surface. The grooves have the effect of reducing particles settling effect and acting as an alternative surface that resists erosion.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "top" and "bottom", "front" and "rear", "inner" and "outer", "above", "below", "upper" and "lower" and the like are used as words of convenience to provide reference points and are not to be construed as limiting terms.

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

The reference numerals in the following claims do not in any way limit the scope of the respective claims.

TABLE OF PARTS

Pump apparatus 200
Pump 10
Pedestal or base 112
Outer casing 22
Side casing parts or sections 23, 24
Inlet hole 28
Outlet hole 29
Pump inner liner 11
Main liner 12
Side liners 14, 30
Main body 100
First side 15
Second side 18
Side surface 16
Pumping chamber 42
Seal chamber housing 114
Chamber 118
Drive shaft 116
Stuffing box 117
Impeller 40
Hub 41
Pumping vanes 43
Eye portion 47
Passage 33
Front shroud 50
Back shroud 51
Impeller inlet 48
Hole 17
Inner face 55
Outer face 54
Peripheral edge portion 56
Inner face 53
Outer face 52
Peripheral edge portion 57
Pumping vanes 43
Auxiliary vanes 60
Auxiliary vanes 61
Main body 31
Inlet section 32
Outermost end 34
Innermost end 35
Lip 38
First side 63
Second side 65
Outer edges 67, 68
Peripheral side wall 69
Inner edge 61
Impeller inlet 52
Outer region 70
Intermediate region 71
Inner region 72
Surface 37
Outer region 76
Intermediate region 77
Inner region 78
Gap 80
Outer opening 82
Inner opening 83
Two formations 90
Inner formation 91
Outermost formation 92
Intermediate formations 93
Outer edge 13
Side wall section 130
Outer edge 133
Formations 95
Outer formation 132
Formations 134
Recesses 94, 136
Plane 140,142,143
Plane 110
Centre 113

The invention claimed is:

1. A pump front side part for use with a centrifugal slurry pump for pumping a fluid mixture containing particulate matter, the pump side part comprising a main body having a main axis (Y-Y), the main body including a side wall section which extends laterally with respect to the main axis and has opposite facing first and second sides, the main body further including an inlet section which extends from the first side in the direction of the main axis and is co-axial therewith, the inlet section having an outermost end and an innermost end defining a passage of the inlet section therebetween, an outer peripheral side wall or rim extending between the first and second sides, the second side having an outer edge adjacent the peripheral side wall or rim and an inner edge located at the innermost end of the passage of the inlet section, a plurality of formations on a surface of the second side including an inner formation and an outer formation in spaced relation to the inner formation, the formations being circular or ring like in configuration when viewed in the direction of the main axis (Y-Y) and arranged concentrically with the main axis (Y-Y), wherein the formations are in the form of channels or recesses in the surface of the second side, and the channels are continuous and arcuate in cross-sectional profile to effect a reduction of particle settling effect on the second side of the side wall section, wherein the second side includes an inner region inclined in a direction away from the first side of the side wall section as the inner region extends towards the inner edge, and wherein the inner formation is located on the inner region of the second side and encircles the inner edge and the inner formation is smaller in size than the outer formation.

2. A pump front side part according to claim 1 wherein the inner formation is adjacent to the inner edge and the outer formation is adjacent to the outer edge.

3. A pump front side part according claim 1 further including one or more intermediate formations, the intermediate formations being circular ring like in configuration and arranged concentrically with the main axis (Y-Y) and in spaced relation to one another and the inner and outer formations.

4. A pump front side part according to claim 1 wherein the surface of the second side is wave like in cross-sectional profile.

5. A pump front side part according to claim 4 wherein the formations have smooth sides and include a smooth transition between formations along the surface of the second side.

6. A pump front side part according to claim 4 wherein the formations include formation curves that are inclined from a plane in line with the general direction of the surface at less than 45°.

7. A pump front side part according to claim 1 wherein the second side includes a section which is at right angles to the main axis Y-Y.

8. In combination, a slurry pump front side part according to claim 1 and a slurry pump impeller;

the impeller comprising a back shroud and a front shroud and a plurality of pumping vanes, each shroud having an outer face, and an impeller inlet, the impeller inlet being coaxial with an impeller rotation axis (X-X);

wherein the outer face of the front shroud and the surface of the second side of the pump front side part are arranged in use to be facing one another with a gap therebetween, the gap having an outer gap opening and an inner opening.

9. The combination of claim 8 wherein the outer face of the front shroud of the impeller includes an outer region, an inner region and an intermediate region therebetween, the intermediate region being in a plane at right angles to the impeller rotation axis (X-X) and the inner region being inclined towards the pumping vanes; and wherein the surface of the second side of the pump front side part includes an outer region, the inner region and an intermediate region between the outer region of the second side and the inner region of the second side, the inner region of the pump front side part extending in a direction away from the intermediate region and in a direction away from the first side of the side wall section of the pump front side part and following the inner region of the outer face of the impeller front shroud, and wherein the outer face of the impeller shroud and the surface of the second side of the pump front side part are arranged in use to be facing one another with a gap therebetween, the gap having an outer gap opening and an inner gap opening, the surface of the second side of the side wall section of the pump front side part being configured so that the cross-sectional dimension of the gap increases in a direction toward the impeller rotation axis (X-X) in the intermediate region of the second side of the pump front side part, and the inner region of the second side of the pump front side part terminates at the inner gap opening.

10. The combination according to claim 9, wherein the dimension of the gap between the inner region of the outer face of the front shroud and the inner region of the surface of the second side of the pump front side part decreases in a direction from the intermediate region of the pump front side part towards the inner edge.

11. A pump front side part according to claim 1 wherein the inner formation is smaller in size than the outer formation.

12. A pump front side part according to claim 1 wherein the surface of the second side comprises an outer region and an intermediate region the outer and intermediate regions and being generally at right angles to the main axis.

13. A pump front side part according to claim 1 wherein there is a maximum of two inner formations located on the inner region.

* * * * *